United States Patent [19]

Goodson

[11] 3,978,557

[45] Sept. 7, 1976

[54] APPARATUS FOR SPREADING AND GUIDING A TUBULAR FABRIC

[76] Inventor: Sam M. Goodson, 1107 Fleetwood Drive, Lookout Mountain, Tenn. 37350

[22] Filed: May 12, 1975

[21] Appl. No.: 576,381

[52] U.S. Cl. ..... 26/84

[51] Int. Cl.[2] ..... D06C 5/00

[58] Field of Search ..... 26/55 R, 55 C, 56, 84, 26/85

[56] References Cited

UNITED STATES PATENTS

| | | | |
|---|---|---|---|
| 2,590,938 | 4/1952 | Cohn et al. | 26/55 R |
| 2,623,263 | 12/1952 | Dungler | 26/55 R |
| 3,007,223 | 11/1961 | Wehrmann | 26/56 X |
| 3,217,361 | 11/1965 | Ryan et al. | 26/55 R UX |
| 3,811,159 | 5/1974 | Cecere | 26/55 R |
| 3,882,577 | 5/1975 | Aronoff | 26/55 R |

*Primary Examiner*—Robert R. Mackey

*Attorney, Agent, or Firm*—Stevens, Davis, Miller & Mosher

[57] ABSTRACT

An apparatus for spreading and guiding a tube of fabric which includes four free turning spheres, two of which are associated with and magnetically attracted to a respective drive sheave and the other two of which are associated with and magnetically attracted to a respective pair of drive sheaves. Upon rotation of their respective drive sheaves, each free turning sphere, by reason of its magnetic attraction thereto, rotates with the drive sheave or sheaves and, since the spheres are positioned inside and the sheaves outside of the tube of fabric, it is thereby conveyed. One pair of guide rods are connected to a pair of the spheres on one side of the apparatus and another pair of guide rods are connected to a pair of the spheres on the other side of the apparatus. Each guide rod extends through guide rings projecting from the surface of the spheres for connection therewith. The pair of guide rods on one side of the apparatus are a mirror image of the pair of guide rods on the other side of the apparatus about a vertical plane extending longitudinally and centrally through the apparatus. Each guide rod of a pair is a mirror image of the other on each side of a substantially horizontal plane which passes through the center of the spheres. Each guide rod is in contact with the other guide rod of its pair at each end thereof and extends from its contact with the other guide rod progressively away therefrom and inwardly in a direction toward the other pair of guide rods to its connection with one of the spheres and then extends substantially straight between its connection with that sphere and its connection with the other sphere. Each guide rod then extends from its connection with the other sphere progressively toward the other guide rod and outwardly in a direction away from the other pair of guide rods to its contact with the other guide rod at the end thereof. The end portions of the guide rods are bevelled so as to present a narrow edge for feeding the tube of fabric being conveyed as far as possible into the nip of a pair of rolls for subsequent processing of the fabric.

7 Claims, 5 Drawing Figures

APPARATUS FOR SPREADING AND GUIDING A TUBULAR FABRIC

CROSS-REFERENCE TO RELATED APPLICATION(S)

This application is related to applicant's abandoned U.S. Pat. application No. 415,305 filed Nov. 13, 1973.

BACKGROUND OF THE INVENTION

1. Field of the Invention

This invention relates to the spreading and guiding of tubular fabric.

2. Description of the Prior Art

Various devices in the prior art have been provided for the purpose of spreading and guiding a tube of fabric for the processing thereof. A description of several of these prior art devices is given below.

U.S. Pat. No. 2,507,559 to G. A. Johnson discloses a tubular fabric spreader comprising a symmetrical framework having two generally parallel panels which are spaced apart so that they can receive therebetween a plurality of rotary members. The rotary members are drive through a belt system to thereby convey the fabric along the length of the panels during which time the fabric is progressively spread by the panels.

U.S. Pat. No. 2,130,118 to S. Cohn discloses a fabric feeding system in which a tube of fabric is stretched over a front spreader and is then passed over castings on each side and then along rear spreader bars into a pair of rolls.

U.S. Pat. No. 2,589,344 to S. Cohn et al. discloses an apparatus for treating tubular textile fabrics having a pair of frames which carry rollers and pulleys disposed respectively at the central and end portions of the frame. Belts are disposed about the pulleys so that the belts are exposed to and engage the edges of the fabric which are advanced continually in a flattened and laterally spread condition.

U.S. Pat. No. 2,013,632 to M. M. Kasanof discloses a fabric treating machine in which the tube of fabric is fed to a pair of blade members which may be adjusted toward and away from each other to vary the width of the spreader. The blade members function to feed the fabric between a pair of cylinders and to change its shape from that of open-tubular form to flat-tubular form.

SUMMARY OF THE INVENTION

The invention comprises two laterally spaced bearing blocks on each of which is mounted a pair of rotatable drive sheave means and a single drive sheave means longitudinally spaced from the pair. Each pair of sheave means and single sheave means have associated therewith and magnetically attracted thereto a free turning sphere. Upon rotation of the sheave means, the sphere magnetically attracted thereto is rotated therewith with the spheres inside and the sheave means outside the tube of fabric so that the tube of fabric is spread and conveyed thereby for processing of the fabric. This processing may include the feeding of the tube of fabric into a pair of rolls which, if the fabric is wetted by any type of substance, for example, a liquid dye, the rolls function to squeeze the liquid from the tube of fabric prior to further processing thereof. To assist in moving the tube of fabric into the spreading and conveying means, i.e., the sheave means and the spheres, and to assist in guiding the tube of fabric from the spreading and conveying means into the nip of the rolls, the invention further includes two pair of guide rods. One pair of guide rods are connected to diametrically opposite portions of the pair of spheres on one side of the apparatus and the other pair of guide rods are connected to diametrically opposite portions of the pair of spheres on the other side of the apparatus. The pair of guide rods on one side of the apparatus are a mirror image of the pair of guide rods on the other side of the apparatus about a vertical plane extending longitudinally and centrally through the apparatus. Each guide rod of each pair is a mirror image of the other guide rod of that pair about a horizontal plane which extends through the center of the spheres. The guide rods of each pair are connected to each other at each end thereof and are bevelled at the ends so that the tubular knit fabric passing over those ends is not interrupted by any projecting portions of the rods. Each guide rod extends, from its point of contact with the other guide rod at the end thereof, upwardly and inwardly toward the pair of guide rods connected to the other pair of spheres. Each guide rod of each pair then extends substantially straight between its connection with the one sphere and its connection with the other sphere, and from its connection with the other sphere, each guide rod then extends progressively downwardly and outwardly in a direction away from the other pair of guide rods and terminates in its point of contact at the end with the other guide rod of that pair. The bevelled ends of the guide rods do not interrupt the movement of the fabric thereover and can guide the tube of fabric as far as possible into the nip of a pair of rolls, such as squeeze rolls, which may function to remove any excess liquid, such as dye, from the fabric.

DESCRIPTION OF THE PREFERRED EMBODIMENT

Figure 1:
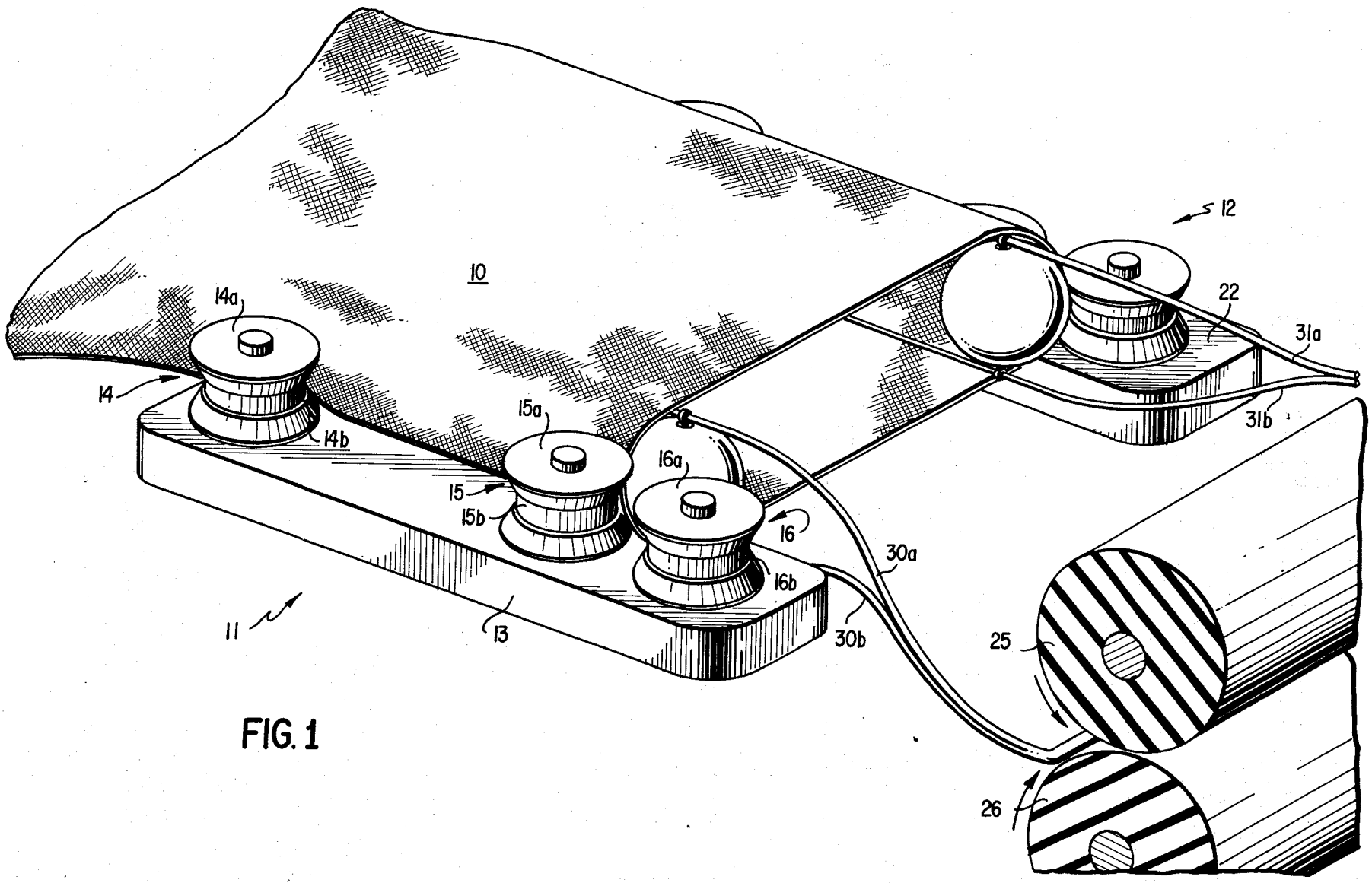
FIG. 1 is a perspective view of the apparatus for spreading and guiding a tube of fabric of this invention.

With reference to the accompanying drawings, in FIG. 1 is shown a tube of knit fabric 10 which is just entering one portion of gripping and propelling or spreading and conveying devices 11 and 12 which are disposed on opposite sides of the tube of fabric when the tube is in a somewhat distended condition. The gripping and propelling device 11 comprises a bearing block 13, a single sheave 14 and a pair of sheaves 15 and 16 which are spaced from the single sheave 14. Each of the sheaves 14 through 16 are mounted on driving shafts suitably mounted in the bearing block 13. The sheaves 14 through 16 comprise flange portions **14*a* through 16*a* respectively and intermediate portions 14*b* through 16*b* respectively which may be a permanent magnet. These permanent magnets, through their magnetic field, attract to themselves a sphere of magnetizable material. A sphere 17 is associated with and is magnetically attracted by the single sheave 14 and a sphere 18 is associated with and magnetically attracted by the pair of sheaves 15 and 16**.

On the right side of the machine as it is viewed in FIG. 1, there are disposed a single sheave 19 and a pair of sheaves 20 and 21 which are longitudinally spaced from the single sheave 19. The sheaves 19 through 21 are mounted on driving shafts which are supported in a bearing block 22. The sheaves 19 through 21 correspond in structure and function to the sheaves 14 through 16 and they have corresponding magnetized portions which, through their magnetic field, are associated with and magnetically attract a magnetizable sphere. A sphere 23 is associated with and magnetically attracted by the single sheave 19 and a sphere 24 is associated with and magnetically attracted by the pair of sheaves 20 and 21. The sheaves 14 through 16 and 19 through 21 are driven in a direction indicated by the arrows in FIG. 2. As the particular mechanism for driving the sheaves forms no part of the present invention, a detailed illustration thereof is believed unnecessary.

As each of the sheaves 14 through 16 and 19 through 21 magnetically attract and pull their respective spheres into a position of contact, the spheres are so actually rotated by the respective sheaves when the sheaves are in rotation.

In conveying and spreading the tubular fabric into, through and beyond the gripping and pulling or spreading and conveying devices 11 and 12, it is desired that the movement be accomplished as easily as possible so as to not in anyway unduly tension or stretch the fabric to thereby prevent damage thereto. In such further processing of the tube of fabric, the tube may be fed from the gripping and pulling devices 11 and 12 into a pair of counter rotating rolls 25 and 26. These rolls function, in the event that the fabric has been wetted by any substance, for example a washing liquid or a liquid dye, to remove, by squeezing, that liquid from the tube of fabric.

Figure 2:
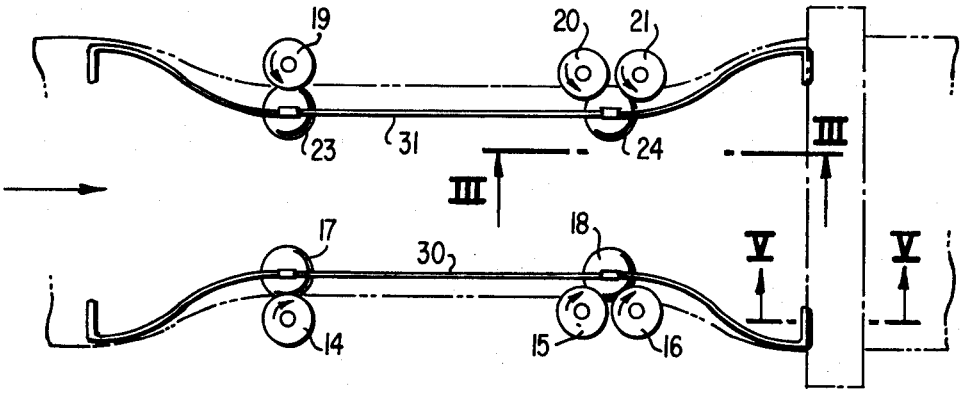
FIG. 2 is a plan view of the apparatus of FIG. 1.
Figure 4:
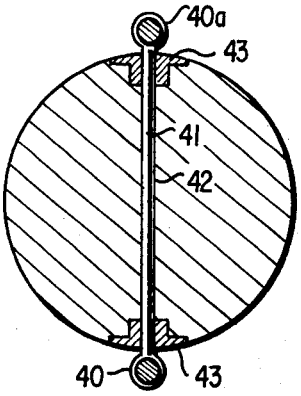
FIG. 4 is a sectional view taken along line IV—IV of FIG. 3.
Figure 3:
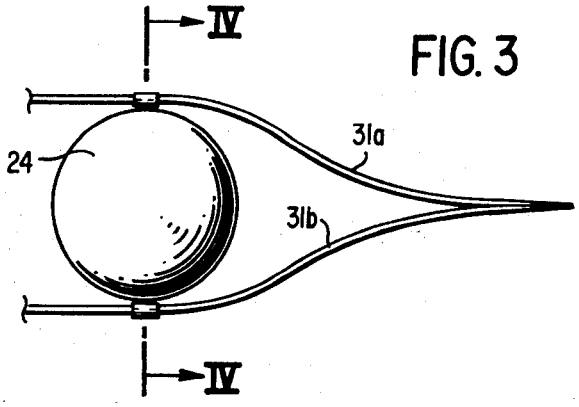
FIG. 3 is a sectional view along line III—III of FIG. 2.
Figure 5:
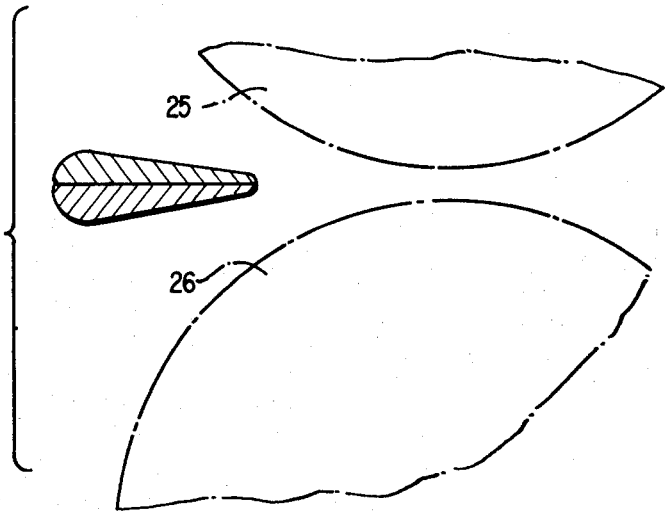
FIG. 5 is a sectional view taken along the line V—V of FIG. 2.

To guide the tube of fabric to, through and beyond the gripping and pulling devices 11 and 12, this invention provides a guide bar or rod means connected to each pair of spheres on each side of the tube of fabric. As shown in FIGS. 1 and 2, a guide bar means 30 is connected to the spheres 17 and 18 and a guide bar rod means 31 is connected to the spheres 23 and 24. The guide bar means 30 is a mirror image of the guide bar means 31 about a vertical plane extending longitudinally and centrally through the apparatus. Each guide bar means comprises a pair of guide bars or rods. As shown in FIG. 1, the guide bar means 30 includes an upper guide rod 30*a* and a lower guide rod 30*b*. Likewise, the guide bar means 31 comprises an upper guide rod 31*a* and a lower guide rod 31*b*. Each upper guide rod is a mirror image of the lower guide rod of each guide bar means about a horizontal plane which extends through the center of the spheres. The upper and lower guide rods of each guide bar means are connected at their end portions and, as shown in FIG. 3, are bevelled at their ends so as to present a narrow edge. Each upper or lower guide rod extends from its point of contact with the other guide rod at the left hand end, as shown in FIG. 1, and extends away from the other guide rod in a direction toward the other guide bar means up to its point of contact with the rearwardmost sphere 17 or 23, then extends substantially straight between the pair of spheres to which it is connected, and then extends from its connection to the forwardmost sphere downwardly toward the other guide rod and in a direction away from the other guide bar means back into its contact at the end portion with the other guide rod. By reason of the shape of the guide bar means, the tube or fabric moving into and beyond the gripping and pulling or spreading and conveying devices 11 and 12 is kept as fully that, without unduly stretching or damaging the fabric, as possible so that the fabric does not become wrinkled at any portion thereof. Also, by reason of the bevelled end portions of the guide bar means, the guide bar means present no projections or obstacles to the continuing movement of the tube of fabric to thereby further assist in the continuous uninterrupted movement of the tube of fabric. Furthermore, because the forwardmost or right hand end of the guide bar means, as shown in FIG. 1 is bevelled, the tube of fabric is guided as far as possible, as shown in FIG. 5, into the nip of the rolls 25, 26 so that the movement of the fabric from the guide bar means into the rolls 25, 26 is a continuous uninterrupted movement which does not damage the fabric.

As shown in FIG. 2, the guide bar means are wider at each end thereof than in the region between the spheres so that the peripheral dimensions of the tube of fabric is held taut over the guide bar means. The fabric at the left and right hand ends, in FIG. 2, is held in flat-tubular form, and at the region adjacent to and between the spheres, is held in open-tubular form. By reason of the structural conformation of the guide bar means, the tube of fabric progressively changes cross-section shape from open-tubular to flat-tubular form and vice versa without unduly stretching or wrinkling the fabric.

The guide rods are connected to their respective spheres by means of rings 40 which are connected to each end of a shaft 41 which extends through a substantially vertical annular passage 42 in each sphere. Each guide bar may be connected to the ring by being force fitted therein, by welding, or by any other suitable connecting means. Bearings 43 permit rotation of each sphere about the axis of each shaft 41.

It is also contemplated in this invention, that the rearwardmost sheaves 14 and 19 and the spheres 17 and 23 associated therewith could be eliminated. However, these sheaves and associated spheres are desirable in that they render more stable the guide bar means. If these spheres 17, 23 and sheaves 14, 19 were not present, the guide bar means 30 and 31 would have to be interconnected for example, at the rear end thereof, to provide stability to the guide bar means, as otherwise, each guide bar means 30 and 31 could rotate about the substantially vertical extending axis of the respective sphere 18 or 24 to which they are connected.

The bearing blocks 13 and 22 may be interconnected by a mechanism which secures them in a fixed manually adjustable spaced relationship. This interconnection may be in the form of a turnbuckle which consists of oppositely threaded portions which are threaded into the blocks. A driving surface, such as a nut, may be provided so that an operator with a conventional open end wrench can adjust the relative spacing between the bearing blocks 13 and 22 so as to accommodate fabric tubes of different sizes. Such as turnbuckle is shown and described in applicant's above referred to copending U.S. patent application No. 415, 305, whose disclosure is incorporated by reference herein.

It is also contemplated in this invention, that it may be desirable to reverse the positions of the magnets and the magnetizable material. For example the balls 17, 18, 23 and 24 may be permanent magnets and an appropriate magnetizable material can be used in the manufacture of the sheaves. It is further contemplated as part of this invention to use electromagnets rather than permanent magnets so that the strength of the magnetic field can be increased or decreased as desired.

The operation of the apparatus for spreading and guiding tubular knit fabric will now be described.

It is to be understood that before the fabric is introduced the spheres will actually touch the driving surfaces of the sheaves. When the fabric is introduced, an operator manually opens the end of the tube of fabric 10 and manually retracts the spheres 17, 18, 23 and 24 from the respective sheaves to which they are magnetically attracted, and slips the fabric into the position shown in FIG. 1. The operator may further pull the fabric in a direction toward the right, as shown in FIG. 1, and feed it into the nip of the rolls 25, 26 so that it may then be pulled by those rolls upon their rotation. The operator then actuates the various driving mechanisms for driving the sheaves and rolls in the directions shown by the arrows in the drawings. When the tube of fabric 10 is once caught up between the gripping and propelling or spreading and conveying mechanisms 11 and 12 and the rolls 25, 26 the tube of fabric commences to be propelled from left to right as shown in FIG. 1 of the drawing. Driving forces extend through the fabric by reason of the magnetic field between the sheave means and their respective spheres so that the fabric, as it moves from left to right is opened or spread and guided by the guide bar means 30, 31 into the nip of the rolls 25, 26. By reason of the shaping of the guide bar means, particularly as shown in FIG. 2, the tubular fabric 10 is held in its open or spread position and is prevented from being wrinkled, unduly tensioned or stretched so that the fabric is not thereby damaged. Also, as shown in FIG. 1, 2 and 5, by reason of the bevelled ends of the forwardmost portion of the guide bar means, the tube of fabric is guided as far as possible into the nip of rolls 25, 26.

What I claim is:

1. Apparatus for spreading and guiding a tube of fabric comprising:

six contoured sheave means each of which is rotatable about a substantially vertical central axis, two pair of free turning bodies, one body of each pair being associated with a respective one of the sheave means and the other body of each pair being associated with a respective pair of the sheave means on each side of the spreading apparatus, means to establish a magnetic attraction between each body and its respective sheave means, means supporting said sheave means in mutually spaced relationship in two groups of three sheave means each on each side of the spreading apparatus with a pair of the three being longitudinally spaced from the remaining one of the three so as to accommodate an open tube of fabric therebetween with the bodies inside and the sheave means outside the fabric tube, means for driving said sheave means, and a guide bar means connected to each pair of free turning bodies, each guide bar means comprising a pair of elongated guide bars which are connected to opposing portions of a respective pair of free turning bodies, each of said guide bars being a mirror image of the other on each side of a substantially horizontal plane which passes through the mid-portion of the free turning bodies, each guide bar being in contact with the other guide bar of the pair at each end thereof and extending from its contact with the other guide bar progressively away from the other guide bar and inwardly in a direction toward the other pair of guide bars to its connection with one of the pair of respective free turning bodies, being substantially straight between its respective pair of free turning bodies and then extending from its connection with the other one of the pair of respective free turning bodies progressively toward the other guide bar and outwardly in a direction away from the other pair of guide bars to its contact with the other guide bar.

2. The apparatus of claim 1, wherein:

the ends of each guide bar are bevelled so that the ends of each guide bar means is a narrow edge.

3. The apparatus of claim 1, wherein:

each free turning body is a sphere.

4. The apparatus of claim 1, wherein:

each guide bar is a guide rod.

5. The apparatus of claim 4, further comprising:

means defining a substantially vertical annular passage through each free turning body, a shaft in each passage, a ring connected to each end of each shaft through which the guide rods extend for connection to the free turning bodies, and bearing means between each shaft and its respective free turning body.

6. Apparatus for spreading and guiding a tube of fabric comprising:

six contoured sheave means each of which is rotatable about a substantially vertical central axis, two pair of free turning spheres, one sphere of each pair being associated with a respective one of the sheave means and the other sphere of each pair being associated with a respective pair of the sheave means on each side of the spreading apparatus, means to establish a magnetic attraction between each sphere and its respective sheave means, means supporting said sheave means in mutually spaced relationship in two groups of three sheave means each on each side of the spreading apparatus with a pair of the three being longitudinally spaced from the remaining one of the three so as to accommodate an open tube of fabric therebetween with the spheres inside and the sheave means outside the fabric tube, means for driving said sheave means, means defining a substantially vertical annular passage through each sphere, a shaft in each passage, a guide ring connected to each end of each shaft, and a guide rod means connected to each pair of spheres, each guide rod means comprising a pair of elongated guide rods which extend through the guide rings for connection to the respective spheres, each of said guide rods being a mirror image of the other on each side of a substantially horizontal plane which passes through the center of the spheres, each guide rod being in contact with the other guide rod of the pair at each end thereof and extending from its contact with the other guide rod progressively away therefrom and inwardly in a direction toward the other pair of guide rods to its connection with one of the pair of respective free turning spheres, being substantially straight between its respective pair of spheres, and then extending from its connection with the other one of the pair of respective spheres progressively toward the other guide rod and outwardly in a direction away from the other pair of guide rods to its contact with the other guide rod.

7. The apparatus of claim 6, wherein:

each of said shafts has a length substantially that of the respective passage in which it is positioned, and the rings on each end of the shaft project outwardly of the surface of the respective sphere.

* * * * *